US009949512B2

(12) United States Patent
Liu

(10) Patent No.: US 9,949,512 B2
(45) Date of Patent: Apr. 24, 2018

(54) DETACHABLE ELECTRIC CIGARETTE

(71) Applicant: Tuanfang Liu, Ji'an (CN)

(72) Inventor: Tuanfang Liu, Ji'an (CN)

( * ) Notice: Subject to any disclaimer, the term of this patent is extended or adjusted under 35 U.S.C. 154(b) by 0 days.

(21) Appl. No.: 15/260,273

(22) Filed: Sep. 8, 2016

(65) Prior Publication Data

US 2017/0311646 A1 Nov. 2, 2017

(30) Foreign Application Priority Data

Apr. 27, 2016 (CN) ..... 2016 2 0368886 U

(51) Int. Cl.
*A24F 17/00* (2006.01)
*A24F 47/00* (2006.01)

(52) U.S. Cl.
CPC ..... *A24F 47/008* (2013.01)

(58) Field of Classification Search
CPC ..... A24F 1/30; A24F 1/14; A24F 47/00
USPC ..... 131/173–260, 328–329
See application file for complete search history.

(56) References Cited

U.S. PATENT DOCUMENTS

| | | | | |
|---|---|---|---|---|
| 4,922,901 | A * | 5/1990 | Brooks | A24F 47/006 128/202.27 |
| 4,947,875 | A * | 8/1990 | Brooks | A24F 47/006 128/202.21 |
| 9,451,793 | B2 * | 9/2016 | Zhou | A24F 47/008 |
| 9,497,997 | B2 * | 11/2016 | Wu | A24F 47/008 |
| 9,675,108 | B2 * | 6/2017 | Liu | A24F 47/002 |
| 9,687,029 | B2 * | 6/2017 | Liu | H05B 3/16 |
| 2015/0034104 | A1 * | 2/2015 | Zhou | A24F 47/008 131/329 |
| 2016/0286859 | A1 * | 10/2016 | Liu | A24F 47/008 |
| 2016/0374392 | A1 * | 12/2016 | Liu | H02J 7/0052 392/404 |

* cited by examiner

*Primary Examiner* — Phuong Dinh
(74) *Attorney, Agent, or Firm* — Matthias Scholl, PC; Matthias Scholl

(57) ABSTRACT

An electronic cigarette, including an atomizing assembly and a battery. A first sealing ring is sleeved on an upper connector of atomizing rod. The upper connector is provided with grooves, facilitating a replacement of an atomizer. An atomizing rod is compressed on the upper connector. A threaded copper, a copper circular ring, and a heating wire presser are sleeved on the atomizing rod in that order, and are compressed on a lower connector of atomizing rod. The lower connector is adapted to fix an atomizer core, and the heating wire presser is adapted to support and tighten the atomizer core. The copper circular ring is adapted to ensure uniform forces on the members when the members are closely coordinating.

10 Claims, 5 Drawing Sheets

DETACHABLE ELECTRIC CIGARETTE

CROSS-REFERENCE TO RELATED APPLICATIONS

Pursuant to 35 U.S.C. § 119 and the Paris Convention Treaty, this application claims the benefit of Chinese Patent Application No. 201620368886.X filed Apr. 27, 2016, the contents of which are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, and Cambridge, Mass. 02142.

BACKGROUND OF THE INVENTION

Field of the Invention

The invention relates to an electronic cigarette.

Description of the Related Art

Conventional electronic cigarettes have the following disadvantages:

1. The atomizer core is difficult to be replaced.
2. The disassembly of the battery cell is inconvenient, and often damages the protection and insulation layers on the outer layer of the battery cell.
3. The electronic cigarette cannot be refilled with tobacco when it is in use.
4. The shell is difficult to be replaced.

SUMMARY OF THE INVENTION

In view of the above-described problems, it is one objective of the invention to provide an improved electronic cigarette.

To achieve the above objective, in accordance with one embodiment of the invention, there is provided an improved electronic cigarette. The electronic cigarette comprises an atomizing assembly and a battery. In the atomizing assembly, a first sealing ring of upper connector is sleeved on an upper connector of atomizing rod. The upper connector is provided with grooves, facilitating a replacement of an atomizer. The atomizing rod is compressed on the upper connector. A threaded copper, a copper circular ring, and a heating wire presser are sleeved on the atomizing rod in that order, and are compressed on a lower connector of an atomizing rod. The lower connector is adapted to fix an atomizer core, and the heating wire presser is adapted to support and tighten the atomizer core. The copper circular ring is adapted to ensure uniform forces on members when the members are closely coordinating.

In a preferred embodiment of the invention, a second sealing ring of limit cover is sleeved on a sealing base of atomizing rod, and is compressed on the lower connector so as to prevent tobacco tar from entering into a polyformaldehyde mouthpiece. The atomizer core is screwed in the lower connector. A third sealing ring of mouthpiece is sleeved on the polyformaldehyde mouthpiece, and is disposed in the upper connector, so that in operation, tobacco tar, smoke, and air are isolated from each other.

In a preferred embodiment of the invention, the integrative electronic sheet comprises a shell. Four first magnets each are disposed on the shell. A second magnet is disposed on a plastic carrier. The plastic carrier comprises a plurality of mounting slots. The four first magnets each are disposed on the mounting slots, correspondingly. The first magnets are adapted to facilitate shell mounting. A printed circuit board (PCB) is also disposed on the plastic carrier. A first screw is adapted to lock the PCB in case of vibration or falling down.

In a preferred embodiment of the invention, the plastic carrier comprises a transverse baffle and a longitudinal baffle, preventing the PCB from moving upwards or downwards. The PCB is diagonally disposed on the plastic carrier, then the PCB is screwed up on and is parallel to the plastic carrier. In addition, a positive welding head is soldered to the plastic carrier, and is disposed on one side of the plastic carrier. A positive input wire of the PCB is soldered to the positive welding head. A negative contact head is disposed on a first hole on the plastic carrier, and is connected to a negative input wire of the PCB.

In a preferred embodiment of the invention, an end of the negative contact head is provided with a negative spring, a spring fixing plate, and a second screw so as to cover the negative contact head, and ensure an elastic and convenient mounting of battery.

In a preferred embodiment of the invention, in the atomizing assembly, a first support base of glass tube comprises a piece of highland barley paper, an insulating ring, and an atomizer connector. The insulating ring is sleeved on the atomizer connector, and the highland barley paper is sleeved on the insulating ring. The first support base is provided with a crevice and a circular hole. The positive input wire passes through the circular hole, and is soldered to the atomizer connector. The negative input wire is soldered to and fixed on the crevice of the support base. In addition, a second support base of airflow regulation ring is configured to regulate airflow, so as to control smoke.

In a preferred embodiment of the invention, a fixing pin of airflow regulation ring is adapted to fix an airflow regulation ring and the second support base. The airflow regulation ring is disposed in a carrier of airflow regulation ring. A fourth sealing ring is disposed in the airflow regulation ring. The airflow regulation ring is provided with a pin hole, and the fixing pin is fixed on the pin hole. The second support base is disposed on the first support base. A silicone oil-baffle is disposed on the plastic carrier. The plastic carrier is provided with a second hole, and two output wires pass through the second hole. The second support base is disposed in the plastic carrier, and is compressed on the first support base.

In a preferred embodiment of the invention, a negative output wire is soldered to a negative welding spot of the PCB, and a positive output wire is soldered to a positive welding spot of the PCB. A panel is fixed on the plastic carrier via a third screw. The panel is provided with a key button and an add-subtract button.

In a preferred embodiment of the invention, a fifth sealing ring of glass tube and an upper cover of glass tube are sleeved on a glass tube. The glass tube is disposed on the first support base. In addition, the atomizer is twisted in the first support base.

In a preferred embodiment of the invention, the shell is provided with four first magnets. The shell is U-shaped, and is provided with magnet slots and glue so as to bond with corresponding magnets.

Advantages of the electronic cigarette according to embodiments of the invention are summarized as follows:

The battery cell can be pushed out from a hole of the main body and be disassembled at any time, thereby causing no damage to the protection and insulation layer on the outer layer of the battery cell. In operation, the tobacco tar can be added in the electronic cigarette at any time. The sealing structure for tobacco tar features simple and practical structure. The airflow is adjustable so as to meet the requirements of smokers. The tobacco tar is added via an oil seal cover; following the addition of tobacco tar, the oil seal cover is covered up, and the tobacco tar is sealed.

DETAILED DESCRIPTION OF THE EMBODIMENTS

Figure 1:
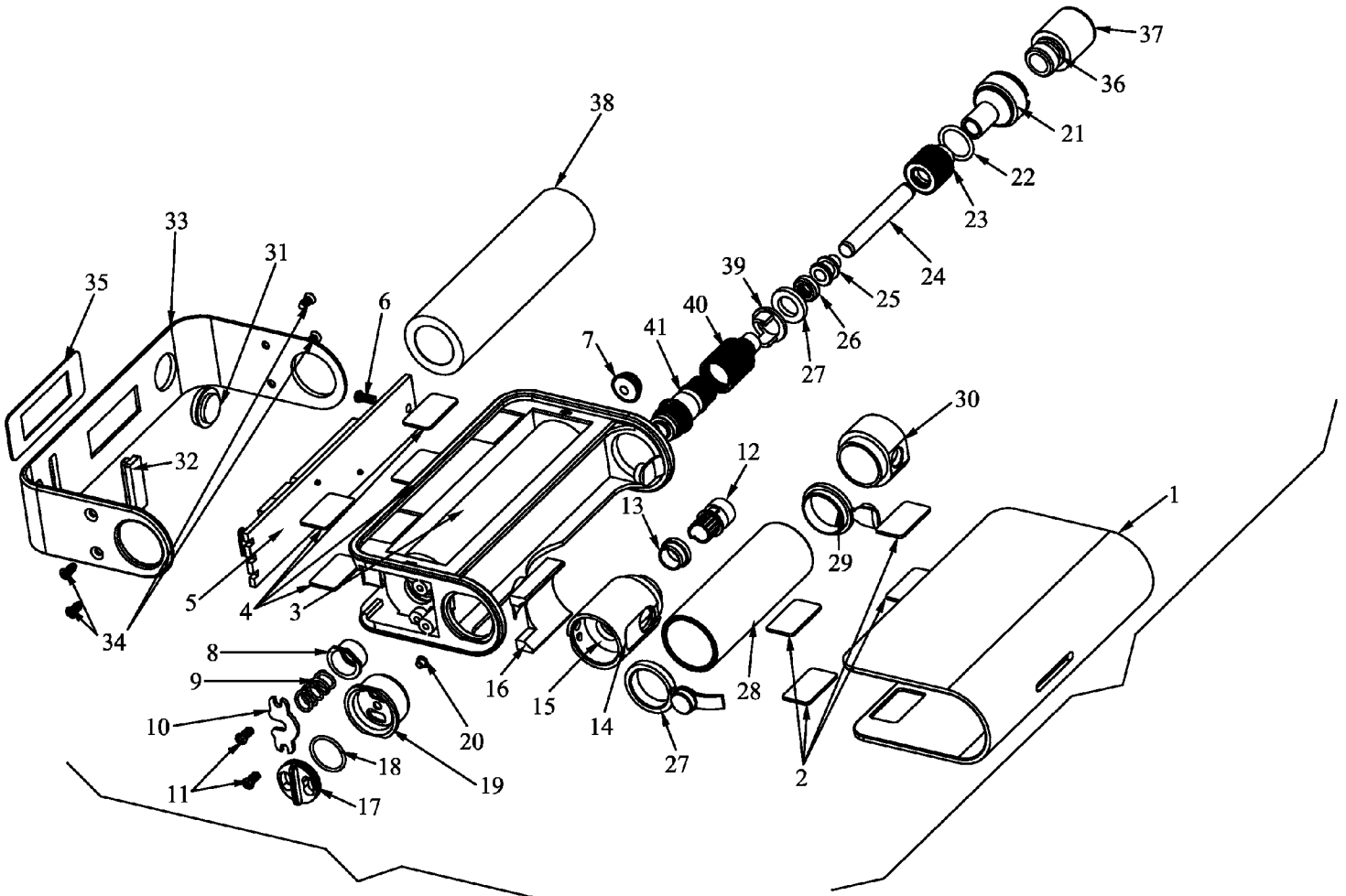
FIG. 1 is an exploded view of an electronic cigarette of an exemplary embodiment of the invention.
Figure 2:
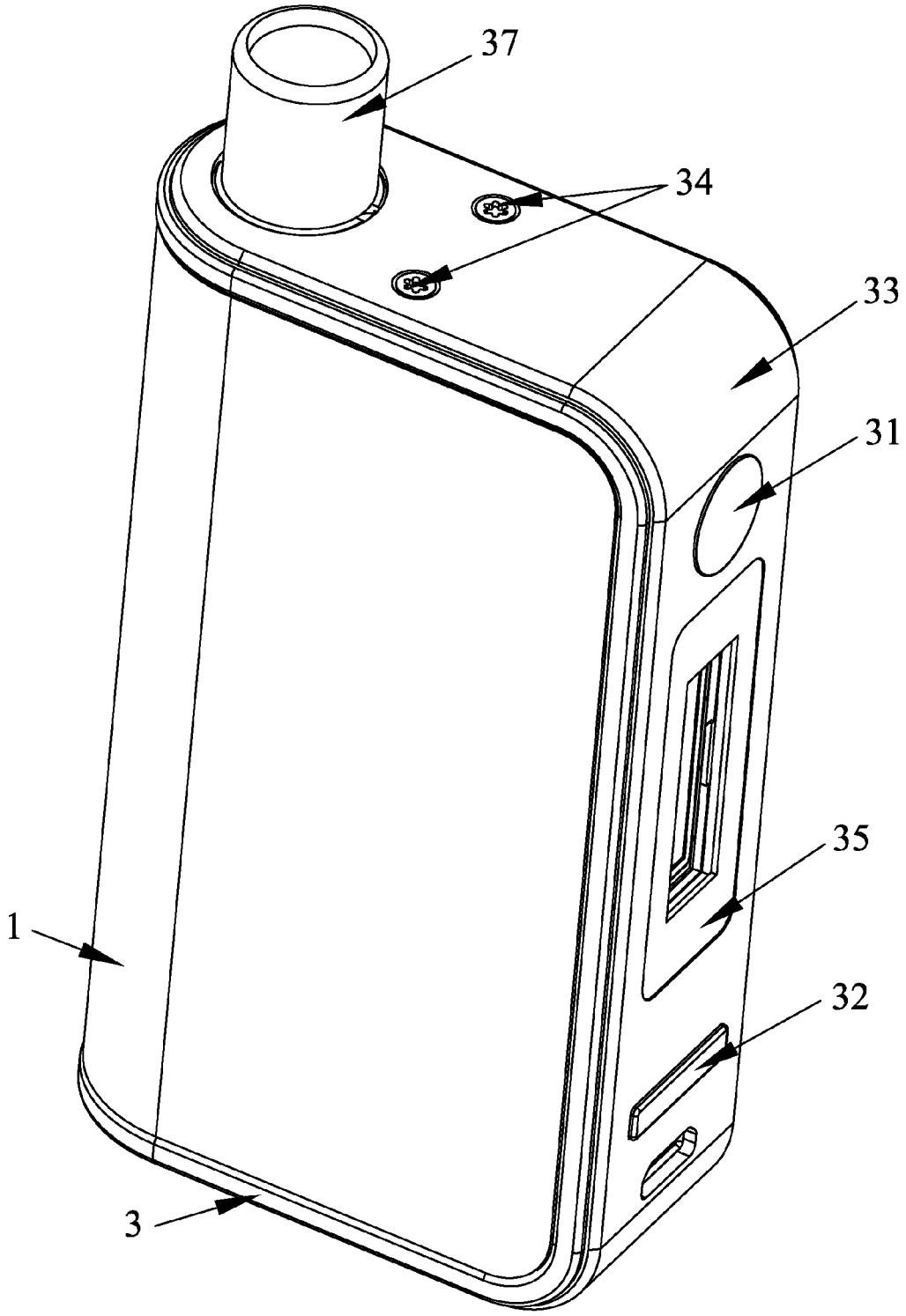
FIG. 2 is a schematic diagram of an electronic cigarette of an exemplary embodiment of the invention.
Figure 3:
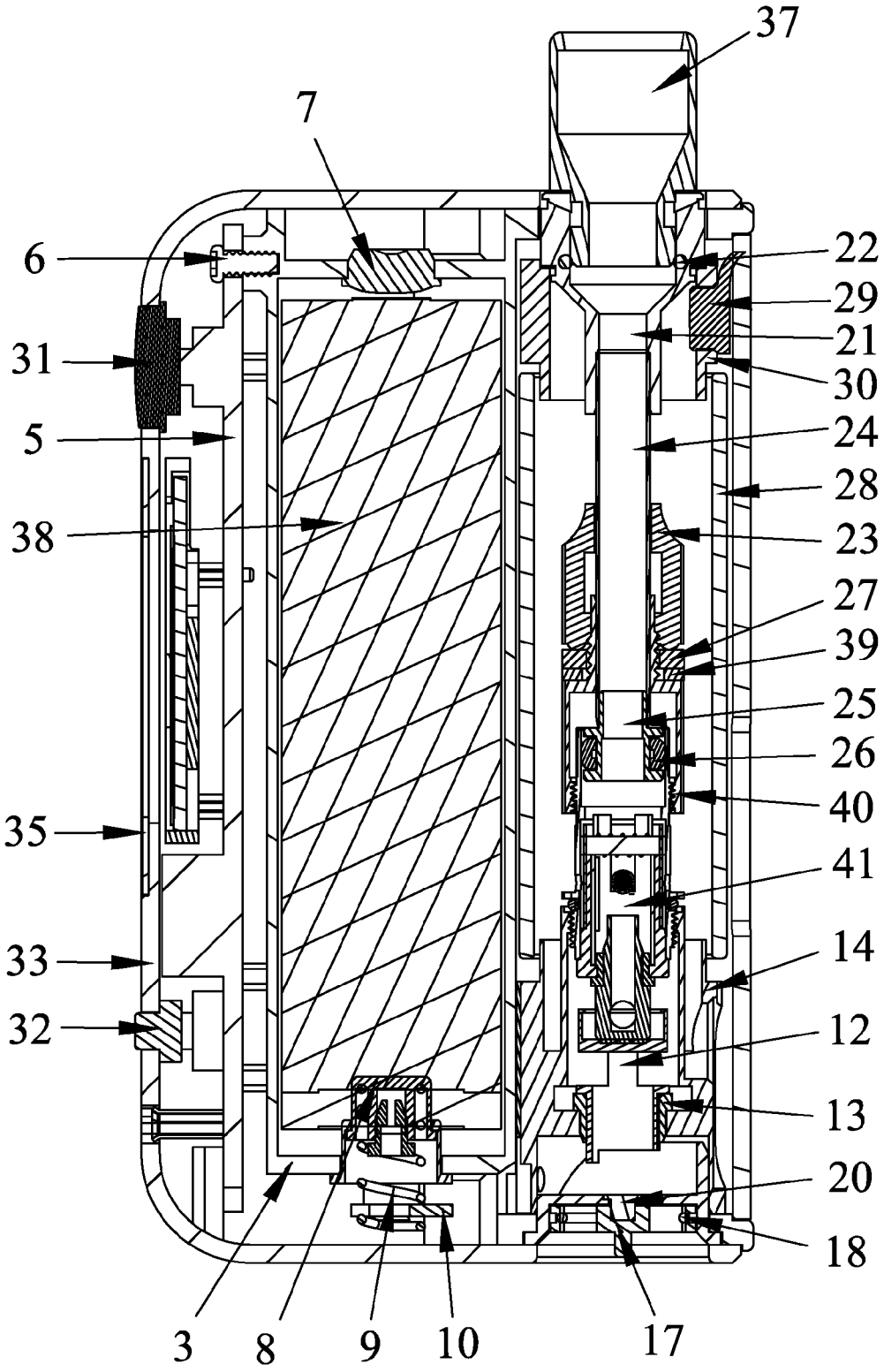
FIG. 3 is a sectional view of an electronic cigarette of an exemplary embodiment of the invention.
Figure 4:
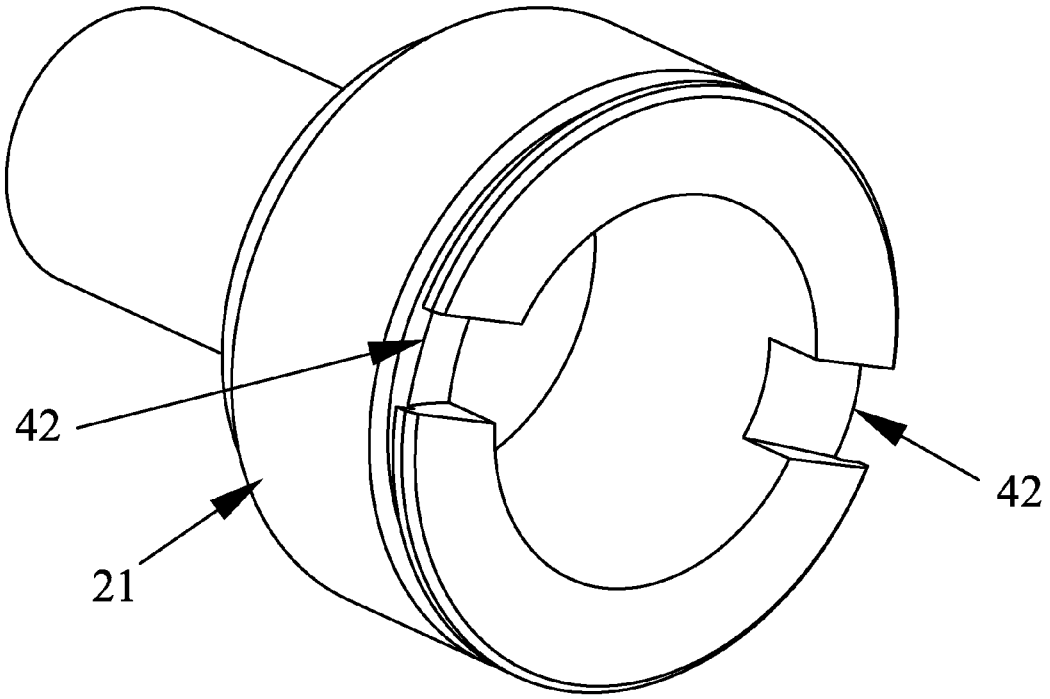
FIG. 4 is a schematic diagram of an upper connector of an exemplary embodiment of the invention.
Figure 5:
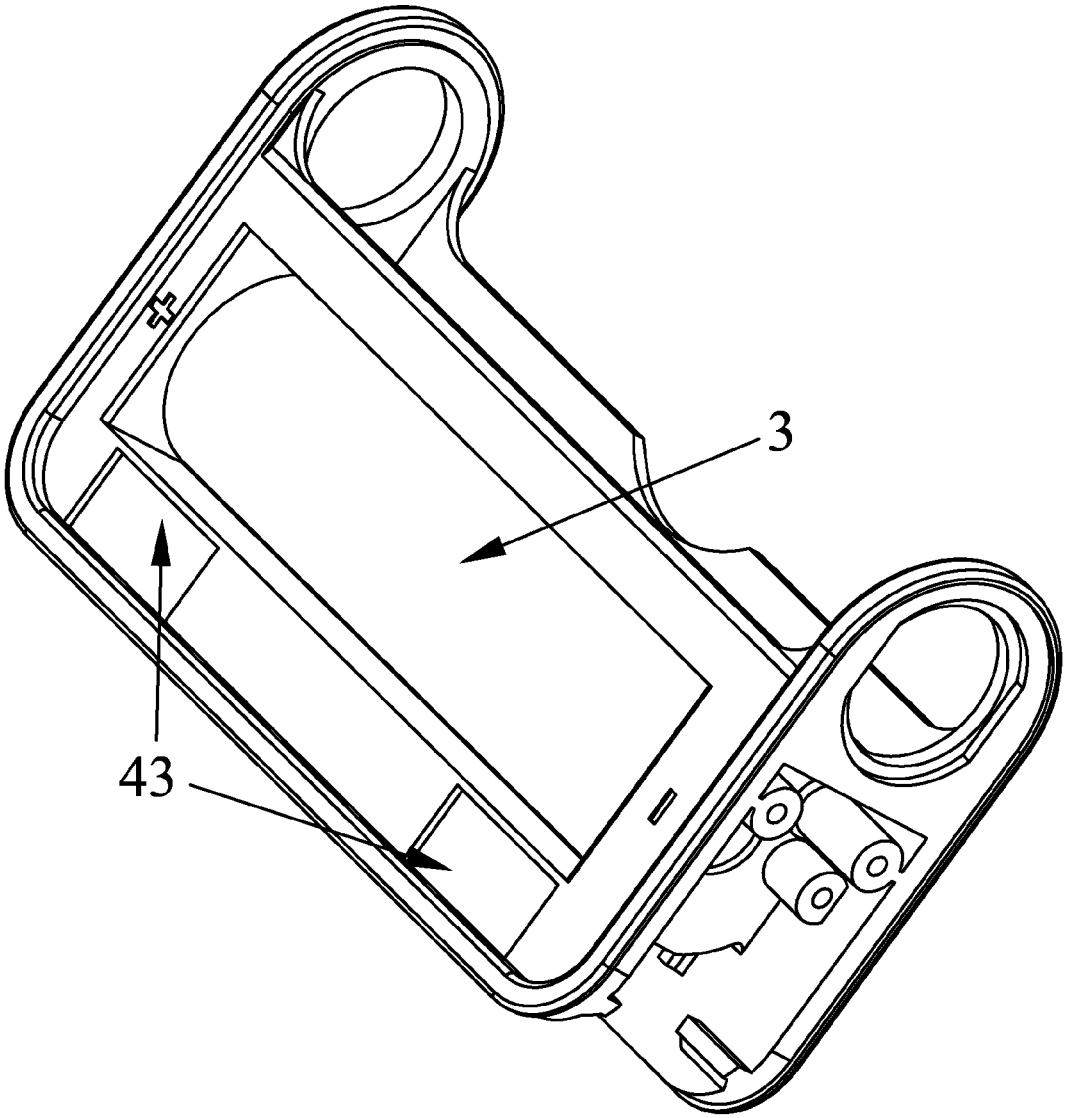
FIG. 5 is a schematic diagram of a plastic carrier of an exemplary embodiment of the invention.

For further illustrating the invention, experiments detailing an electronic cigarette are described below. It should be noted that the following examples are intended to describe and not to limit the invention.

Specifically, in view of the problems in the prior art, in an embodiment of the invention, the atomizer is integrated with the main body, and the atomizer core can be replaced at any time. The electronic cigarette comprises a shell 1, a second magnet 4, a printed circuit board (PCB) 5, a first screw 6, a positive welding head 7, a negative contact head 8, a negative spring 9, a spring fixing plate 10, a second screw 11, an atomizer connector 12, an insulating ring 13, a first support base 14 of glass tube, a highland barley paper 15, a silicone oil-baffle 16, an airflow regulation ring 17, a fourth sealing ring 18, a second support base 19 of airflow regulation ring, a fixing pin 20 of airflow regulation ring, an upper connector 21 of atomizer, a first sealing ring 22 of upper connector, a threaded copper 23, an atomizing rod 24, a sealing base 25 of atomizing rod, a second sealing ring 26 of limit cover, a copper circular ring 27, a glass tube 28, a fifth sealing ring 29 of glass tube, an upper cover 30 of glass tube, a key button 31, an add-subtract button 32, a panel 33, a third screw 34, a decorative plate 35, a third sealing ring 36 of mouthpiece, a polyformaldehyde mouthpiece 37, an battery cell 38, a heating wire presser 39, a lower connector 40 of atomizing rod, and an atomizer core 41.

Specifically, the electronic cigarette comprises an atomizing assembly and a battery. In the atomizing assembly, the first sealing ring 22 of an upper connector is sleeved on the upper connector 21 of an atomizing rod. The upper connector is provided with grooves 42, facilitating a replacement of an atomizer. The atomizing rod 24 is compressed on the upper connector 21. The threaded copper 23, the copper circular ring 27, and the heating wire presser 39 are sleeved on the atomizing rod 24 in that order, and are compressed on a lower connector 40 of an atomizing rod. The lower connector 40 is adapted to fix an atomizer core 41, and the heating wire presser 39 is adapted to support and tighten the atomizer core 41. The copper circular ring 27 is adapted to ensure uniform forces on members when the members are closely coordinating.

In a preferred embodiment of the invention, the second sealing ring 26 of limit cover is sleeved on the sealing base 25 of atomizing rod, and is compressed on the lower connector 40 so as to prevent tobacco tar from entering into the polyformaldehyde mouthpiece 37. The atomizer core 41 is screwed in the lower connector 40. A third sealing ring 36 of mouthpiece is sleeved on the polyformaldehyde mouthpiece 37, and is disposed in the upper connector 21, so that in operation, tobacco tar, smoke, and air are isolated from each other.

In a preferred embodiment of the invention, the integrative electronic sheet comprises the shell 1. Four first magnets 2 are disposed on the shell 1. The second magnet 4 is disposed on a plastic carrier 3. The plastic carrier comprises a plurality of mounting slots 43. The four first magnets 2 are disposed on the mounting slots 43, correspondingly. The first magnets are adapted to facilitate shell mounting. The PCB 5 is also disposed on the plastic carrier 3. The first screw 6 is adapted to lock the PCB in case of vibration or falling down.

In a preferred embodiment of the invention, the plastic carrier 3 comprises a transverse baffle and a longitudinal baffle, preventing the PCB from moving upwards or downwards. The PCB is diagonally disposed on the plastic carrier, then the PCB is screwed up on and is parallel to the plastic carrier. In addition, the positive welding head 7 is soldered to the plastic carrier 3, and is disposed on one side of the plastic carrier. A positive input wire of the PCB is soldered to the positive welding head. The negative contact head 8 is disposed on a first hole on the plastic carrier, and is connected to a negative input wire of the PCB.

In a preferred embodiment of the invention, an end of the negative contact head 8 is provided with the negative spring 9, the spring fixing plate 10, and the second screw 11 so as to cover the negative contact head 8, and ensure an elastic and convenient mounting of battery.

In a preferred embodiment of the invention, in the atomizing assembly, the first support base 14 of glass tube comprises a piece of highland barley paper 15, an insulating ring 13, and the atomizer connector 12. The insulating ring 13 is sleeved on the atomizer connector, and the highland barley paper 15 is sleeved on the insulating ring 13. The first support base 14 is provided with a crevice and a circular hole. The positive input wire passes through the circular hole, and is soldered to the atomizer connector. The negative input wire is soldered to and fixed on the crevice of the support base. In addition, the second support base 19 of airflow regulation ring is configured to regulate airflow, so as to control smoke.

In a preferred embodiment of the invention, the fixing pin 20 of airflow regulation ring is adapted to fix the airflow regulation ring 17 and the second support base 19. The airflow regulation ring 17 is disposed in a carrier of airflow regulation ring. The fourth sealing ring 18 is disposed in the airflow regulation ring. The airflow regulation ring is provided with a pin hole, and the fixing pin 20 is fixed on the pin hole. The second support base is disposed on the first support base. The silicone oil-baffle 16 is disposed on the plastic carrier 3. The plastic carrier is provided with a second hole, and two output wires pass through the second hole. The second support base is disposed in the plastic carrier, and is compressed on the first support base.

In a preferred embodiment of the invention, a negative output wire is soldered to a negative welding spot of the PCB, and a positive output wire is soldered to a positive welding spot of the PCB. The panel 33 is fixed on the plastic carrier via the third screw 34. The panel is provided with the key button 31 and the add-subtract button 32.

In a preferred embodiment of the invention, the fifth sealing ring 29 of glass tube and the upper cover 30 of glass tube are sleeved on the glass tube 28. The glass tube is disposed on the first support base. In addition, the atomizer is twisted in the first support base.

In a preferred embodiment of the invention, the shell 1 is provided with four first magnets 2. The shell 1 is U-shaped, and is provided with magnet slots and glue so as to bond with corresponding magnets.

Advantages of the electronic cigarette according to embodiments of the invention are summarized as follows:

The battery cell can be pushed out from a hole of the main body and disassembled at any time, thereby causing no damage to the protection and insulation layer on the outer layer of the battery cell. In operation, the tobacco tar can be added in the electronic cigarette at any time. The sealing structure for tobacco tar features simple and practical structure. The airflow is adjustable so as to meet the requirements of smokers. The tobacco tar is added via an oil seal cover; following the addition of tobacco tar, the oil seal cover is covered up, and the tobacco tar is sealed.

Unless otherwise indicated, the numerical ranges involved in the invention include the end values. While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An electronic cigarette, comprising:

an atomizing assembly, the atomizing assembly comprising a first sealing ring, an upper connector, a lower connector, a threaded copper, a copper circular ring, a heating wire presser, an atomizer core, and an atomizing rod; and a battery;

wherein the first sealing ring is sleeved on the upper connector;

the upper connector is provided with grooves;

the atomizing rod is compressed on the upper connector;

the threaded copper, the copper circular ring, and the heating wire presser are sleeved on the atomizing rod in that order, and are compressed on the lower connector;

the lower connector is adapted to fix the atomizer core to the atomizing rod, and the heating wire presser is adapted to support and tighten the atomizer core; and the copper circular ring is adapted to tightly fix the heating wire presser to the lower connector.

2. The electronic cigarette of claim 1, wherein a second sealing ring of limit cover is sleeved on a sealing base of atomizing rod, and is compressed on the lower connector to prevent tobacco tar from entering into a polyformaldehyde mouthpiece; the atomizer core is screwed in the lower connector; a third sealing ring of the mouthpiece is sleeved on the polyformaldehyde mouthpiece, and is disposed in the upper connector.

3. The electronic cigarette of claim 1, wherein the electronic cigarette comprises a shell; four first magnets each are disposed on the shell; a second magnet is disposed on a plastic carrier; the plastic carrier comprises a plurality of mounting slots; the first magnets are disposed on the mounting slots; a printed circuit board (PCB) is also disposed on the plastic carrier; a first screw is provided to lock the PCB.

4. The electronic cigarette of claim 3, wherein the plastic carrier comprises a transverse baffle and a longitudinal baffle, preventing the PCB from moving upwards or downwards; the PCB is diagonally disposed on the plastic carrier, then the PCB is screwed on and is parallel to the plastic carrier; a positive welding head is soldered to the plastic carrier, and is disposed on one side of the plastic carrier; a positive input wire of the PCB is soldered to the positive welding head; a negative contact head is disposed on a first hole on the plastic carrier, and is connected to a negative input wire of the PCB.

5. The electronic cigarette of claim 4, wherein an end of the negative contact head is provided with a negative spring, a spring fixing plate, and a second screw.

6. The electronic cigarette of claim 1, wherein the atomizing assembly comprises a glass tube and a first support base comprising a piece of highland barley paper, an insulating ring, and an atomizer connector; the insulating ring is sleeved on the atomizer connector, and the highland barley paper is sleeved on the insulating ring; the first support base is provided with a crevice and a circular hole; a positive input wire passes through the circular hole, and is soldered to the atomizer connector; a negative input wire is soldered to and fixed on the crevice of the first support base; the atomizing assembly also comprises a second support base of the airflow regulation ring configured to regulate airflow and control smoke amount.

7. The electronic cigarette of claim 6, wherein a fixing pin is provided to fix the airflow regulation ring and the second support base; the airflow regulation ring is disposed in a carrier of airflow regulation ring; a fourth sealing ring is disposed in the airflow regulation ring; the airflow regulation ring is provided with a pin hole, and the fixing pin is fixed on the pin hole; the second support base is disposed on the first support base; a silicone oil-baffle is disposed on a plastic carrier; the plastic carrier is provided with a second hole, and two output wires pass through the second hole; the second support base is disposed in the plastic carrier, and is compressed on the first support base.

8. The electronic cigarette of claim 7, wherein a negative output wire is soldered to a negative welding spot of the PCB, and a positive output wire is soldered to a positive welding spot of the PCB; a panel is fixed on the plastic carrier via a third screw; the panel is provided with a key button and an add-subtract button.

9. The electronic cigarette of claim 8, wherein a fifth sealing ring and an upper cover are sleeved on the glass tube; the glass tube is disposed on the first support base; in addition, the atomizer is twisted in the first support base.

10. The electronic cigarette of claim 1, wherein a shell is provided with four first magnets; the shell is U-shaped, and is provided with magnet slots and glue so as to bond with corresponding magnets.

* * * * *